United States Patent [19]

Walor

[11] Patent Number: 4,905,298

[45] Date of Patent: Feb. 27, 1990

[54] RESEALABLE CLOSURE

[76] Inventor: Curtis J. Walor, 732 Greenbriar Ter., Crystal Lake, Ill. 60014

[21] Appl. No.: 282,625

[22] Filed: Dec. 12, 1988

[51] Int. Cl.[4] ..... B65D 33/16

[52] U.S. Cl. ..... 383/95

[58] Field of Search ..... 383/95, 52, 43, 48, 383/59; 229/485 B; 206/632

[56] References Cited

U.S. PATENT DOCUMENTS

| | | | |
|---|---|---|---|
| 3,181,583 | 5/1965 | Lingenfelter | 383/61 X |
| 3,307,773 | 3/1967 | Krutzer et al. | 383/86 X |
| 3,310,225 | 3/1967 | Hoblit et al. | 383/86 |
| 3,325,083 | 6/1967 | Frye | 383/42 |
| 4,500,021 | 2/1985 | Bildusas | 383/95 X |
| 4,842,421 | 6/1989 | Bullard et al. | 383/61 |

FOREIGN PATENT DOCUMENTS

| | | | |
|---|---|---|---|
| 0239319 | 8/1987 | European Pat. Off. | 383/61 |

*Primary Examiner*—Daniel P. Stodola
*Assistant Examiner*—William G. Battista, Jr.
*Attorney, Agent, or Firm*—Plante, Strauss Vanderburgh & Connors

[57] ABSTRACT

There is disclosed a releasable closure for a container which is particularly suitable for plastic bags. The closure is formed by a pair of opposed bands of static cling vinyl film, preferably polyvinyl chloride, which extend along the mouth of the container and which are permanently secured thereto. The bands of static cling vinyl extend inwardly, into the container where they form internal flaps that are coextensive the length of the mouth of the container, thereby forming internal flaps within the bag. These internal flaps provide the pressure resistant capability of the resealable closure, permitting it to retain its fluid-tight characteristic against internal pressures.

8 Claims, 2 Drawing Sheets

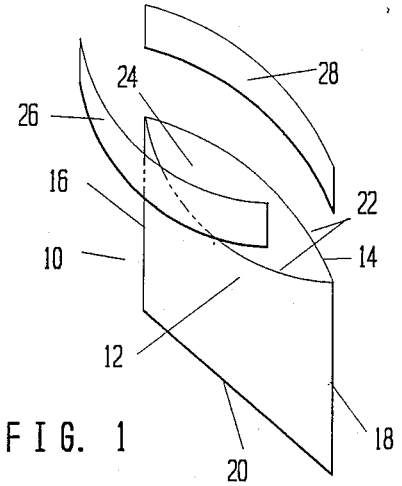
FIG. 1
FIG. 2
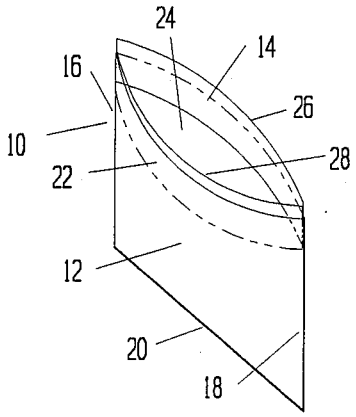
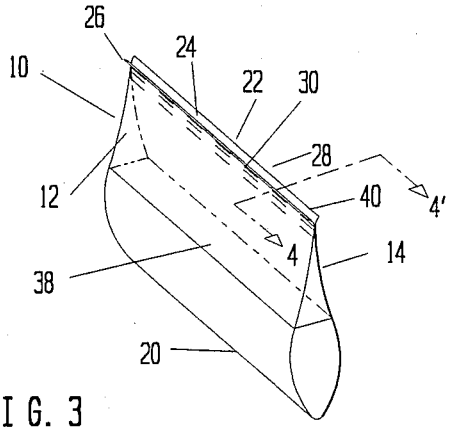
FIG. 3

RESEALABLE CLOSURE

BACKGROUND OF THE INVENTION

1. Field of the Invention

This invention relates to a resealable closure and, in particular, to a resealable closure particularly useful for plastic bags.

2. Brief Statement of the Prior Art

Plastic bags are used to preserve many items, such as food, mechanical items, electronic components and circuits, etc. In all of the applications it is desirable to have a resealable and reusable closure that will permit reuse of the plastic bag.

Mechanical closures have been developed in which a bead and a mating groove are formed on opposed edges of plastic bags, e.g, the ubiquous Baggies. Although the mechanical closures are fairly useful and will secure a plastic bag in most applications, the mechanical closures are not completely fluid-tight and leakage of fluids such as liquids and gases through the mechanical seal can occur. Consequently, some attempts have been made to provide an adhesive sealing closure, such as the adhesive closure shown in U.S. Pat. No. 3,307,773; and the heat or pressure bonded seal in U.S. Pat No. 3,717,533.

In U.S. Pat. Nos. 3,325,083 and 3,310,225, resealable closure are shown which utilize the self-adhesive property of some plastics particularly chlorinated polyolefins and polyvinyl chloride. In the former patent, the entire plastic container or bag is formed of self-adhesive polyvinyl chloride which is calendared in the areas which are to be non-adherent, leaving a small seal band at the top of the bag which is the uncalendered polyvinyl chloride. –

A difficulty with this attempt is that it limits the useful materials and designs for the plastic bags. In U.S. Pat. No. 3,310,225, the self adhesive plastic is applied as a band along an external sealing flap of the plastic bag. The attempts of both of these patented inventions have a common disadvantage, which is that the seals are not effective against internal pressure and a fluid tight seal is thus difficult to achieve.

It is accordingly an objective of this invention to provide an economical closure for plastic bags and the like which is resealable, thereby permitting reuse of the plastic bags.

It is an additional object of this invention to provide a resealable closure for plastic bags which is fluid-resistant.

It is a further object of this invention to provide a closure for plastic bags which can withstand internal pressures within the bag while maintaining a fluid-tight seal.

It is also an objective of this invention to provide a resealable closure which is very economical and which can be fabricated without complex equipment. Other and related objectives will be apparent from the following description of the invention.

BRIEF STATEMENT OF THE INVENTION

This invention is a resealable closure for a container, which is particularly suitable for plastic bags and the like. The closure is formed by a pair of opposed bands of static cling vinyl film, preferably polyvinyl chloride, which extend along the mouth of the container and which are permanently secured thereto. The bands of static cling vinyl extend inwardly, into the container where they form internal flaps that are coextensive the length of the mouth of the container.

The container can be any shape and of any material having a flexible or foldable closure flap. It can be of rigid construction such as a box, but is preferably of flexible material such as plastic film or glasine paper. It can be of tubular or bag construction.

In the most preferred embodiment, the container is a plastic bag formed of two layers of plastic sheets which are joined along their marginal bottom and side edges, leaving an open top edge that forms the mouth of the bag. The resealable closure is formed with the pair of bands of static cling vinyl permanently bonded to the marginal top edges of the opposite plastic sheets forming the plastic bag. As previously mentioned, the inner edges of these static cling vinyl bands are unattached to the respective sheet layers, thereby forming internal flaps within the bag. These internal flaps provide the pressure-resistant capability of the resealable closure, permitting it to retain its fluid-tight characteristic against internal pressures.

BRIEF DESCRIPTION OF THE FIGURES

The invention will be described with reference to the Figures of which;

FIG. 1 is an exploded perspective view of the resealable closure of the invention with a plastic bag;

FIG. 2 is a perspective view of the assembled closure on a plastic bag;

FIG. 3 is a perspective view of the closed bag with the resealable closure of the invention;

DESCRIPTION OF PREFERRED EMBODIMENTS

Figure 4:
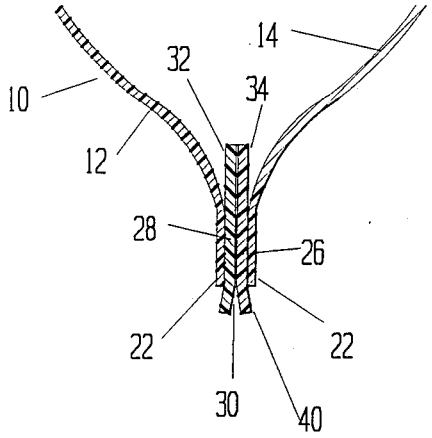
FIG. 4 is an enlarged sectional view along line 4—4 of FIG. 3.

Referring now to FIGS. 1 and 2, the invention is illustrated as applied to a conventionally formed plastic bag 10. The plastic bag 10 is formed of two sheets 12 and 14 of plastic film, typically from about 0/001 to 0.01 inch thickness. Suitable plastics for this application are any of the readily available thermoplastics such as polyethylene, polypropylene, polyvinyl chloride, polyvinyl acetate, copolymers of ethylene and vinyl acetate, etc.

The static cling property can be imparted to plastic film by including a high content of plasticizer in the plastic. Polyvinyl chloride films with this property are commercially available from several sources. An example of film having an acceptable static cling property for use in the invention is Sure-State Series 9000, which is available from Tekra Corporation, New Berlin, Wisc.

The bag 10 is formed in the conventional manner with the marginal side edges 16 and 18, and bottom edges 20 of the plastic sheets 12 and 14 being permanently bonded together by suitable means, e.g, cement, thermal or ultrasonic bonding, etc. This construction leaves the top marginal edges 22 of the bag 10 unattached, thereby forming a mouth 24 providing access to the interior of the bag.

In accordance with this invention, a pair of bands 26 and 28 of static cling vinyl are used in combination with the bag 10 and are located adjacent the marginal top edges 22 of the sheets, co-extensive therewith to form the re-closure seal 30 of the bag. Various material can be used for the static cling vinyl. Typically the surface of these plastic materials exhibiting the static-cling property are quite porous having, in affect, microscopic suction cups which in part to the plastic the capability of sealing against smooth surfaces and, in particularly, forming very tight seals against itself.

The aforementioned bands 26 and 28 of static-cling vinyl are narrow with a sufficient length to be entirely co-extensive with the unsecured marginal top edges 22 of the sheets of plastic sheets 12 and 14 forming the bag 10. These bands of static-cling vinyl are permanently secured to the marginal top edges 22 as illustrated in FIG. 2. The bands 26 and 28 project inwardly of the closure to form inner flaps 32 and 34 which are unsecured along their entire length. This is achieved by securing the bands of static-cling vinyl to the sheet materials of the bag 10 along a narrow band 26 which is less than the entire width of the static-cling vinyl. The width of the unsecured inner flaps can be varied from about 5 to about 90% of the width of the bands of the static-cling vinyl. Preferably the width of the inner flaps are from about 15 to about 25% of the width of the static-cling vinyl bands.

Referring now to FIG. 3, the bag 10 is shown in its closed and sealed condition. In the illustration, the bag is filled with a material such as a powdered solid, gas or liquid 38, and bulges outwardly under the weight and/or internal pressure of its contents. The re-closure seal 30 maintains the bag sealed and prevents leakage or contamination of the contents.

Referring to FIG. 4, there is illustrated an enlarged sectional view along line 4–4' of FIG. 3. As there illustrated, the re-closure seal 30 is formed of the parallel and opposed bands 26 and 28 of static-cling vinyl which have been pressed together to affect sealing of the bag 10. The internal pressure within the bag is exerted on the inner flaps 32 and 34 of the bands 26 and 28 of the static-cling vinyl with the result that any internal pressure within the bag enhances the sealing of the closure since the internal pressure is applied to the inner flaps of each of the static cling vinyl bands, pressing them together tightly, thereby preventing leakage of the contents of the bag.

Figure 5:
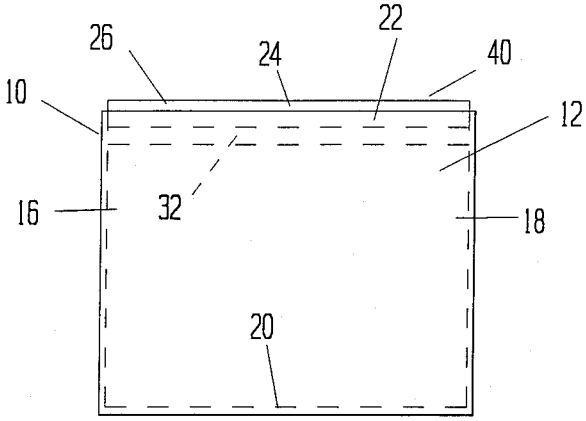
FIG. 5 is a side view of the plastic bag shown in FIG. 2.

Referring now FIG. 5, the bag is shown in an elevational view as a conventionally formed bag 10 having marginal right and left side edges 16 and 18, and bottom marginal edges 20 bonded together. Its upper marginal edges 22 are unbonded to provide a mouth for the bag. Received on these marginal upper edges 22 are the bands 26 and 28 of static-cling vinyl. Preferably, the bands of static-cling vinyl extend slightly above the marginal edges of the bag to provide external flaps 40 of the static-cling vinyl, thereby providing ease in grasping of the closure and opening and closing of this closure.

Figure 6:
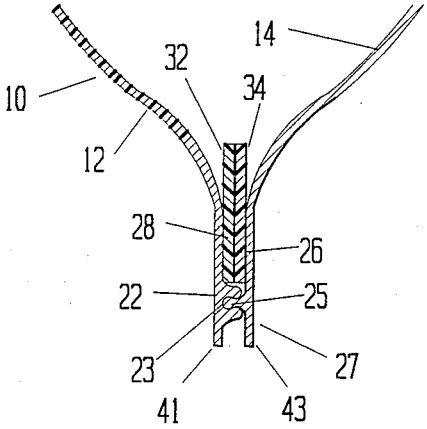
FIG. 6 is a sectional view of a mechanical closure combined with the resealable closure of this invention.

The resealable closure can, if desired, be combined with a mechanical seal. An example is shown in FIG. 6, which is a sectional view through the closure of a plastic bag of the type shown in FIGS. 1 and 2. In this application, the bands 26 and 28 of static cling vinyl are permanently bonded to sheets 12 and 14 along their outermost marginal edges adjacent to a coextensive mechanical lock 27 which lies along the marginal edges 41 and 43 of the opposite plastic sheets 12 and 14. As with the prior embodiment, the reclosure is coextensive the entire mouth of the plastic bag.

The inner marginal edges of the bands 26 and 28 are not bonded to the sheets 12 and 14, thereby forming the internal flaps 32 and 34, such as previously described. These form the pressured seal, all as described with reference to FIG. 4.

The mechanical lock includes a groove 23 formed by parallel upstanding beads on the inside surface adjacent to the outer marginal edge 41 of sheet 12 and a coacting key 25 formed by a single upstanding bead on the inside surface adjacent the outer marginal edge 43 of sheet 14. The beads can, if desired, have a slightly bulbous cross-section, as shown, to provide a dovetail interlock. Preferably the marginal edges 41 and 43 extend slightly beyond the beads to provide lips useful to pull the closure apart.

In the embodiment shown in FIG. 6, the bands of static cling vinyl provide a pressure seal which prevents leaking and contamination of the product and the mechanical seal enhances the strength of the seal.

The closure of the invention is suitable for containing solid and fluid contents and preventing leaking of the contents or transmission of gas or vapor through the resealable closure. As the closure does not depend on mechanical locking, it can be sealed and resealed multiple times without losing its effectiveness. Furthermore, the provision of the inner flaps on the internal marginal edges of the closure bands insures that any pressure developed within the bag, either static liquid pressure or internal gas pressure, will enhance the sealing of the closure and prevent leakage of the contents of the bag.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A resealable container having a reclosure seal that includes at least one sealing flap formed of a flexible thermoplastic film having a sealing surface and located opposite a coacting sealing surface, the improvement comprising:

a. a first band of a static cling vinyl plastic received within said container adjacent said sealing surface of said flap and with its outer edge permanently bonded to said sealing surface and with its inner edge being unbonded to said sealing surface, thereby forming an inner flap; and b. a second band also of a static cling vinyl plastic received within said container adjacent said coacting sealing surface and with its inner edge permanently bonded to said coacting sealing surface and with its inner edge being unbonded to said coacting sealing surface, thereby forming a second inner flap, whereby said first and second bands can be removably secured together to form a seal along their entire width, including said inner flaps within said container.

2. The resealable container of claim 1 formed entirely of a flexible plastic film.

3. The resealable container of claim 2 wherein said plastic film of said plastic film bag is polyethylene.

4. The resealable container of claim 3 wherein said static cling plastic is polyvinyl chloride.

5. The resealable container of claim 1 in the form of a plastic film bag having opposed sheets of plastic permanently bonded together along their bottom and opposite side edges.

6. The resealable container of claim 5 wherein said plastic film bag has said first band of static cling vinyl permanently bonded along the inside upper edge of one of said sheets and said second band of static cling vinyl permanently bonded along the inside upper edge of the other of said sheets, thereby permitting said bands of static cling vinyl to be removably secured together to function as said reclosure seal.

7. The resealable container of claim 1 wherein said first and second bands are coextensive with the upper edges of said plastic sheets.

8. The resealable container of claim 1 wherein said static cling plastic is polyvinyl chloride.

* * * * *